United States Patent [19]

Siedhoff

[11] Patent Number: 4,548,163

[45] Date of Patent: Oct. 22, 1985

[54] HIGH EFFICIENCY FLUID HEATER

[76] Inventor: George H. Siedhoff, 145 N. Terrace, Wichita, Kans. 67208

[21] Appl. No.: 617,897

[22] Filed: Jun. 6, 1984

[51] Int. Cl.[4] ..... F22B 9/02; F21B 21/00

[52] U.S. Cl. ..... 122/13 R; 122/14; 122/17; 122/20 B; 122/367 C

[58] Field of Search ..... 122/13 R, 19, 18, 14, 122/15, 367 R, 367 A, 367 C

[56] References Cited

U.S. PATENT DOCUMENTS

| | | | |
|---|---|---|---|
| 1,991,557 | 2/1935 | Johnson | 122/14 |
| 2,143,287 | 1/1939 | Smith | 122/20 B |
| 4,055,165 | 10/1977 | Scragg et al. | 122/367 R |
| 4,222,350 | 9/1980 | Pompei et al. | 122/367 C |
| 4,401,058 | 8/1983 | Charrier et al. | 122/367 C |
| 4,422,411 | 12/1983 | Thorogood | 122/20 B |
| 4,453,496 | 6/1984 | Yoshinari | 122/13 R |

*Primary Examiner*—Henry C. Yuen

*Attorney, Agent, or Firm*—Edwin H. Crabtree

[57] ABSTRACT

A high efficiency fluid heater used in conjunction with an infrared heater and the like. The heater circulating a fluid such as cold water in a flue housing through a scrubber section and a contact section greatly exposing the water to the heat of the heater and flue gases thereby increasing the efficiency of heating the fluid.

2 Claims, 4 Drawing Figures

HIGH EFFICIENCY FLUID HEATER

BACKGROUND OF THE INVENTION

This invention relates to the heating of a fluid and more particularly but not by way of limitation to a fluid heater used with an infrared heater for circulating cold water and the like through a scrubber section and a contact section providing a more efficient and low cost fluid heater.

Heretofore, there have been various types of hot water heating devices, circulating devices and hot water tanks. These devices and systems are described in the following U.S. Patents, U.S. Pat. No. 2,341,365 to Del Mar, U.S. Pat. No. 3,638,619 to Hall et al, U.S. Pat. No. 3,666,918 to Clark, Jr. et al and U.S. Pat. No. 4,436,058 to McAlister. None of the above mentioned patents described the unique features and advantages of the subject high efficiency fluid heater as described herein.

SUMMARY OF THE INVENTION

The subject high efficiency fluid heater provides an efficient and low cost fluid heater with improved efficiency over a typical standard hot water heater of from 50 to 60 percent to over 90 percent.

The fluid heater can be used for heating cold water in domestic or commercial buildings or can be used with other fluids such as hydrocarbons for various industrial applications.

The invention is compact in design and is easily adaptable for various types of building installations.

The high efficiency fluid heater for heating fluids such as water includes a flue housing having an upper portion and a lower portion. The upper portion has a flue gas outlet with the lower portion having an air inlet. An infrared heater is mounted adjacent the air inlet of the lower portion of the housing. A contact section is mounted in the lower portion of the housing and adjacent the burner. The contact section is made up of a plurality of vertical riser pipes interconnected to an upper and lower horizontal header. The lower horizontal header is connected to a scrubber section mounted inside the upper portion of the flue housing. The scrubber section includes a plurality of interconnected fluid pipe coils disposed along the length of the upper housing with one end of the coils connected to a fluid inlet.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
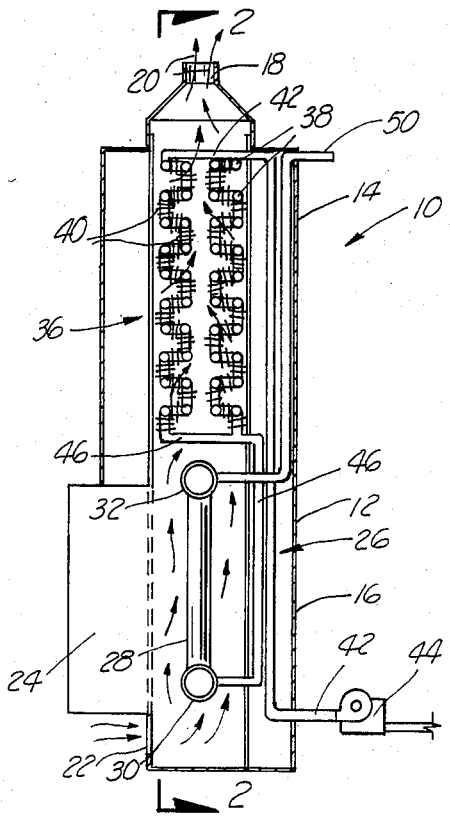
FIG. 1 is a side view of the fluid heater.

In FIG. 1 a side view of the high efficiency fluid heater is shown and designated by general reference numeral 10. The heater 10 includes a flue housing 12 with the sides of the housing 12 cut-away to expose the interior of the heater 10. The housing 12 includes an upper portion 14 and a lower portion 16. The upper portion 14 of the housing 12 includes a flue gas outlet 18 with the flue gas represented by arrows 20.

The lower portion 16 of the housing 12 includes an air inlet 22 for receiving fresh air therethrough. An infrared heater 24 is mounted in the lower portion 16 of the housing 12 and adjacent the air inlet 22 for heating a contact section by radiation. Air heated by convection from the contact section is received through the lower portion 16 and travels upwardly and out the gas outlet 18.

Figure 2:
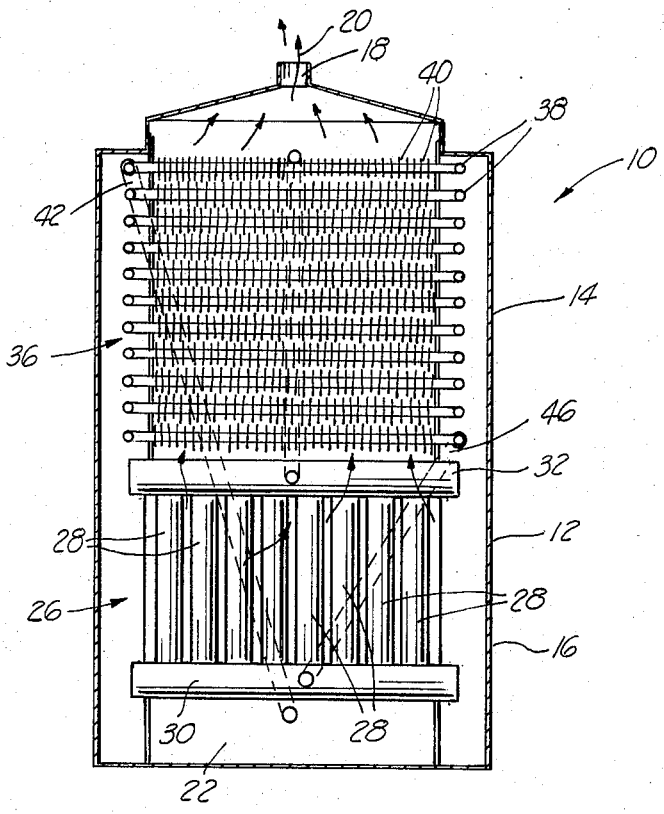
FIG. 2 illustrates a front sectional view of the fluid heater taken along lines 2—2 shown in FIG. 1.

Mounted in the lower portion 16 of the housing 12 is the contact section designated by general reference numeral 26. The contact section 26, which can be seen more clearly in FIG. 2, includes a plurality of vertical riser pipes 28 communicably connected to a lower horizontal header 30 and an upper horizontal header 32. The lower header 30, upper header 32 and vertical riser pipes 28 have an increased volume so the velocity of fluid traveling in this piping arrangement of the heater 10 is reduced to increase the time differential in front of the heater 24.

Disposed in the upper portion 14 of the housing 12 is a scrubber section designated by general reference numeral 36. The scrubber section 36 is made up of a plurality of interconnected fluid pipe coils 38 having radiation fins 40 mounted thereon. The coils 38 are connected to an inlet fluid pipe 42 for receiving fluid under pressure from an inlet pipe pump 44 which pressurizes the fluid to be heated. The fluid which is received through the inlet pipe 42 is discharged at the top of the scrubber section 36 where under pressure the fluid circulates downwardly through the coils 38 where it is discharged into a connecting pipe 46 for discharging the heated fluid to the lower horizontal header 30. In FIG. 1 it can be seen that the flue gases 20 are received around the scrubber section 38 as the heated air is discharged upwardly through the flue gas outlet 18.

The heated fluid, when received in the lower horizontal header 30 as mentioned above is lowered in velocity because of the increased volume in the lower header 30. The heated fluid is then circulated under pressure upwardly in the vertical riser pipes 28 past the front of the infrared heater 24 and into the upper horizontal header 32. From the upper header 32, the heated fluid is discharged out a discharge pipe 50 and into the building for either domestic or commercial use.

Figure 3:
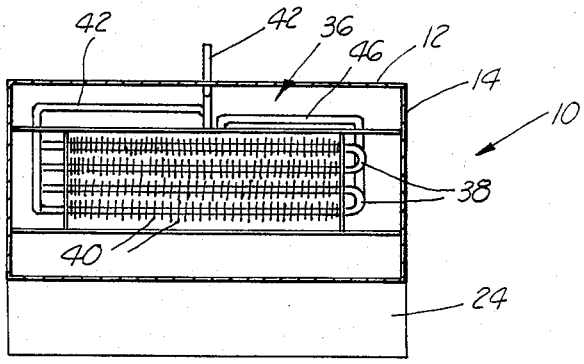
FIG. 3 shows a top view of the fluid heater.

In FIG. 3, a top view of the heater 10 can be seen looking down into the scrubber section 36. In this view the coils 38 can be seen disposed horizontally along the length of the upper portion 14 of the housing 12 with the radiator type fins 40 disposed around the coils 38. Also the top of the burner 24 can be seen in this view.

Figure 4:
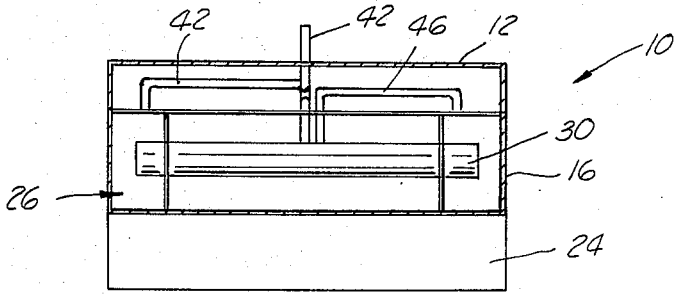
FIG. 4 is a bottom view of the fluid heater.

In FIG. 4 a bottom view of the heater 10 can be seen with the lower horizontal header 30 connected to the connecting pipe 46. Also, in this view, the fluid inlet pipe 42 can be seen.

As described above in the drawings the high efficiency fluid heater provides a unique system using an infrared burner with a scrubber section and a contact section for efficiently exposing a fluid to flue gases for maximum efficiency in heating a fluid for either domestic or commercial use. Through the combination of the contact and scrubber sections 26 and 36 the fluid, under pressure, is heated obtaining over 90 percent efficiency from the heat available for heating a fluid and lowering the cost required in operating a domestic or commercial building.

Changes may be made in the construction and arrangement of the parts or elements of the embodiments as described herein without departing from the spirit or scope of the invention defined in the following claims.

What is claimed is:

1. A high efficiency fluid heater for heating a fluid such as water and the like, the heater comprising:

a flue housing having an upper portion and a lower portion, the upper portion having a flue gas outlet, the lower portion having an air inlet for receiving combustion air which is discharged upwardly;

an infrared heater mounted in the lower portion of the housing;

a scrubber section mounted in the upper portion of the housing, the scrubber section having a plurality of interconnected pipe coils disposed along the length of the upper housing, the pipe coils having fins disposed therearound for increasing the heat exchange of the air circulated therearound, the coils connected to a fluid inlet pipe at the top of the upper portion of the fluid housing for receiving the fluid to be heated therein and circulating the fluid downwardly therefrom, the coils connected to a connecting pipe at the bottom of the upper portion for discharging intermediate heated fluid therefrom;

a contact section mounted in the lower portion of the housing and in front of the infrared heater for receiving direct radiation therefrom, the contact section having a plurality of fluid passages therein for circulating fluids therethrough, the fluid passages connected to a connecting pipe at the bottom of the lower portion of the housing for receiving the intermediate heated fluid, the fluid passages connected to a discharge pipe at the top of the lower portion of the housing for discharging final heated fluid circulated upwardly in a concurrent flow direction to the rising air, the air inlet diposed below the contact section for heating the rising air by convection prior to the heated air being received through the scrubber section; and a fluid pump connected to the fluid inlet pipe for circulating the fluid, under pressure, into the heater.

2. The heater as described in claim 1 wherein the fluid passages of the contact section are a plurality of vertical riser pipes, the riser pipes connected to an upper horizontal header and a lower horizontal header, the lower horizontal header connected to the connecting pipe, the upper horizontal header connected to the discharge pipe.

* * * * *